United States Patent [19]

DeSmet

[11] Patent Number: 4,771,139

[45] Date of Patent: Sep. 13, 1988

[54] KEYBOARD WITH METAL COVER AND IMPROVED SWITCHES

[76] Inventor: Gregory L. DeSmet, 365 S. Rosemead Blvd., Pasadena, Calif. 91107

[21] Appl. No.: 879,284

[22] Filed: Jun. 27, 1986

[51] Int. Cl.[4] ..... H01H 13/70; H01H 3/12

[52] U.S. Cl. ..... 200/5 A; 200/159 B; 200/302.2; 200/304; 200/329; 200/340

[58] Field of Search ..... 200/5 A, 83 B, 86 R, 200/159 B, 160, 302.1, 302.2, 308, 310, 314, 317, 329, 340

[56] References Cited

U.S. PATENT DOCUMENTS

| | | | |
|---|---|---|---|
| 2,890,538 | 6/1959 | Jentges | 40/546 |
| 3,238,344 | 3/1966 | Miachon | 200/302.2 |
| 3,290,439 | 12/1966 | Willcox et al. | 200/5 A X |
| 3,626,171 | 12/1971 | Abramowitz et al. | 200/314 |
| 3,627,935 | 12/1971 | Spievak | 200/5 A X |
| 3,845,260 | 10/1974 | Lohr | 200/159 B X |
| 3,921,750 | 11/1975 | Shames | 340/71 |
| 4,024,368 | 5/1977 | Shattuck | 200/314 |
| 4,056,701 | 11/1977 | Weber | 200/314 |
| 4,078,257 | 3/1978 | Bagley | 364/900 |
| 4,124,879 | 11/1978 | Schoemer | 362/26 |
| 4,163,883 | 8/1979 | Boulanger | 200/314 |
| 4,207,448 | 6/1980 | Furusawa et al. | 200/159 B |
| 4,228,330 | 10/1980 | Larson | 200/5 A |
| 4,249,044 | 2/1981 | Larson | 200/5 A |
| 4,249,054 | 2/1981 | Komaki | 200/5 A X |
| 4,286,129 | 8/1981 | Petit | 200/159 B |
| 4,293,764 | 10/1981 | Amrhein | 200/302 |
| 4,338,502 | 7/1982 | Hashimoto et al. | 200/5 A |
| 4,352,968 | 10/1982 | Pounds | 200/302 |
| 4,365,120 | 12/1982 | Pounds | 200/5 A |
| 4,400,594 | 8/1983 | Serras-Paulet | 200/5 A |
| 4,415,780 | 11/1983 | Daugherty et al. | 200/5 A |
| 4,421,966 | 12/1983 | Pounds | 200/309 |
| 4,449,024 | 5/1984 | Stracener | 200/317 |
| 4,468,542 | 8/1984 | Pounds | 200/5 A |
| 4,491,702 | 1/1985 | Kato | 200/5 A |
| 4,613,736 | 9/1986 | Shichijo et al. | 200/5 A X |
| 4,620,075 | 10/1986 | LaBelle et al. | 200/5 A X |
| 4,636,593 | 1/1987 | Novak et al. | 200/5 A |

FOREIGN PATENT DOCUMENTS

| | | | |
|---|---|---|---|
| 2944304 | 5/1981 | Fed. Rep. of Germany . | |
| 1201045 | 8/1970 | United Kingdom | 200/5 A |

*Primary Examiner*—J. R. Scott

*Attorney, Agent, or Firm*—Lyon & Lyon

[57] ABSTRACT

An improved keyboard is provided with a flexible metal cover, normally closed switches, and multiple throw switches. The metal cover is made flexible in the area of each key or switch by the provision of grooves in the metal surrounding each flexible portion. The normally closed and multiple throw switches include pellets which transmit the actuating force on a key or switch through a substrate on which a switch is mounted. The device may be configured in such a way that the pellet will push the normally closed contacts of a switch out of contact, or the pellet or pellets may mechanically link a stacked set of switches in order to provided ganged, multiple throw operation.

21 Claims, 2 Drawing Sheets

KEYBOARD WITH METAL COVER AND IMPROVED SWITCHES

BACKGROUND OF THE INVENTION

The field of the present invention is keyboards and, more particularly, membrane keyboards.

The use of membrane keyboards is considered advantageous in applications where a sealed matrix is desired, construction is to be simplified, and space is to be conserved. These keyboards are typically thin, utilizing switches which have only a short actuating excursion and are of the normally open type. In order to prevent the introduction of contaminants, and to facilitate the identification of keys, it has been known to provide these keyboards with a flexible plastic cover known as a coverlay.

A disadvantage of plastic coverlays is that plastic suffers undesirable wear from abrasion and from flexing, leading to permanent deformation of the coverlay and obliteration of the key indicia. Another disadvantage of plastic coverlays is that these coverlays may be subject to the destructive effects of chemicals such as solvents and caustic substances. This disadvantage is particularly pronounced where the keyboard is intended for use in a laboratory or industrial environment.

Biological and chemical contamination are considered to be hazardous in the presence of conventional switches which have crevices and minute openings. A membrane coverlay would facilitate decontamination, but many plastics are degraded by chemicals used in decontamination.

A further disadvantage is that plastic coverlays suffer degradation in the presence of heat and ultraviolet light. Radio-frequency radiation is also known to pass through plastic keyboards and interfere with electronic functions of the respective device or other devices. Consequently, keyboard devices are frequently provided with radio-frequency shielding.

It has been known to address some of the disadvantages discussed above with the provision of a metal keyboard cover having hinged key actuators. Such a device is shown in the patent issued to Hashimoto, et al., U.S. Pat. No. 4,338,502, issued July 6, 1982. In this device, the key actuators are made movable by cutting a slot through the cover and partially surrounding each keyboard actuator. This pierced keyboard cover suffers from the disadvantages of allowing the entry of degrading factors such as light, dust, and chemicals into the keyboard and possibly into the mechanism itself. Additionally, the thickness of such a cover is restricted in that the hinge's angle of flex must, under normal pressure, be sufficient to permit the amount of travel required to actuate the electrical contacts lying beneath each key site.

Another device has been discussed in the patent issued to Komaki, U.S. Pat. No. 4,249,054, issued Feb. 3, 1981, which calls for a metal calculator keyboard cover to be made extremely thin contiguous with each key site. Although the metal keyboard cover taught in Komaki is substantially continuous, the thinner areas of the key sites are taught to be in the region of 0.025–0.03 millimeters. This extremely thin dimension is disadvantageous in that a keyboard of that design will not exhibit the desired wear characteristics and may be subject to permanent deformation. These disadvantages are aggravated where the keyboard is relatively large or where it is used in a hostile environment.

A further disadvantage of membrane keyboards of known type is that these keyboards are composed entirely of normally open, single-throw switches. Although many designs of normally closed switches exist, they are too bulky to satisfy the space requirements of a membrane keyboard. Where the circuitry with which the keyboard is to be associated requires the use of a normally closed switch signal, an expedient such as a relay or solid-state inverter must be used. Even where such devices are used, contact bounce not present in normally closed switches may be introduced.

Similarly, multiple throw switches exist in many forms, but all require excessive volume or excursion for efficient use in a membrane keyboard. Conventional switches also carry a risk of explosion in combustible environments unless carefully sealed against the exposure of internal sparking.

SUMMARY OF THE INVENTION

It is therefore an object of the present invention to provide an improved membrane keyboard. It is also an object to provide a membrane keyboard which exhibits the characteristics of resistance to wear, imperviousness to chemical degradation, structural support, immunity to heat and ultraviolet radiation, and/or RF shielding. It is a further object of this invention to provide a membrane keyboard which may be hermetically sealed and made explosion-proof. It is a still further object of this invention to provide a keyboard which includes normally closed switches or multiple throw switches.

According to one embodiment of the present invention, a keyboard array of low excursion or "microtravel" switches is provided with a flexible metal cover, known as a coverlay. The metal coverlay is made flexible by the provision of grooves.

The switches in the array may include normally open switches of known type and normally closed or multiple throw switches constructed according to another embodiment of this invention.

In the first embodiment, a coverlay is fabricated from a single sheet of metal. A plurality of key sites, corresponding to the locations of the switches of the keyboard, are defined on the face of the coverlay. A groove surrounding each key site is provided. The back of the coverlay is also provided with a groove surrounding each key site. The grooves are made by reducing the thickness of the coverlay. Where the edges of the grooves, even if on opposite sides of the coverlay, are laterally adjacent to one another, the flexibility of the key site is enhanced by a bellows-type effect. Thus, the excursion of a key site is sufficient, under normal finger pressure, to activate a switch underlying the key site.

It has been found to be advantageous to provide grooves which intrude approximately half-way through the coverlay and which are spaced not more than approximately twice the thickness of the coverlay apart. Moreover, according to the present invention, additional grooves may be provided to increase flexibility. A valley may also be substituted for the innermost groove, so long as the edge of the valley is laterally adjacent to the groove on the opposite side of the coverlay.

The use of this invention permits the metal coverlay at the key site to be considerably thicker than the extremely thin prior art sites of 0.025–0.03 millimeter. The present invention is known to be effective where the stainless steel coverlay, and its key sites, are 5 mils (0.127 millimeter) thick. Grooves of 2.5 mils (0.064 millimeter) depth and 20 mils width surrounded a movable key site measuring 0.75 inch by 0.60 inch and were laterally separated by about 9 mils.

This thicker key site is more durable and readily supports the etching of indicia which will point out the identity of a given key. Etched indicia are advantageously filled with an epoxy ink, enamel, or acrylics of known type. Moreover, the indicia may be anodically treated and dyed in a fashion known to the art.

In accordance with another embodiment, hermetic sealing is accomplished by providing a ridge around the edge of the metal coverlay. This ridge may be stamped, crimped, or bent. By welding this ridge to another metal sheet the entire keyboard mechanism may be enclosed. By welding the ridge or the flat portion of the membrane to the instrument housing, an integral enclosure is provided.

Where it is desirable to provide a translucent or transparent portion in the metal coverlay, as for a signalling light or video display, a glass or quartz insert may be provided. Preferably, this insert will be fused to the metal coverlay, but it may be bonded with an adhesive such as a silicone sealing adhesive.

The keyboard may be sealed by an adhesive between the various layers of the structure. Adhesive may be applied during assembly, or the layers may be pre-impregnated with a suitable adhesive such as an epoxy.

The keyboard may be constructed of several layers of circuit board material pre-impregnated with epoxy adhesive. The lamination of these substrate layers results in a particularly strong and durable assembly. Moreover, a coverlay, whether metal or not, may be securely bonded to the pre-impregnated substrate, thereby reducing the risk of delamination.

The advantages of the metal membrane of the present invention may be used in conjunction with any micro-travel switch including but not limited to capacitive, Hall-effect, and dome switches as well as piezo-electric and fiberoptic switches. In many instances, a mechanical normally closed switch is desired.

In order to provide a low travel normally closed switch, the present device is provided with a coverlay or other actuating surface known to the art such as a push-button, a dome spring, a non-conductive pellet, and a substrate upon which the dome rests. The substrate includes a hole through which the pellet may extend. The pellet provides a means of communicating the actuating force of a key site through the substrate to a movable electrical contact which is normally closed. When the switch is pressed, the pellet extends through an opening in the substrate and pushes the electrical contacts out of communication, thereby breaking the electrical circuit of the switch.

The upper surface of the substrate may also be equipped with electrical contacts so as to provide a ganged pair of switches, one normally open and one normally closed. Moreover, additional pellets and substrate layers may be added to provide as many vertically adjacent ganged switches as desired, all within a low volume. It will be apparent to those skilled in the art to make the electrical interconnections necessary to accommodate any suitable switch design specification.

In contrast to previous devices, the present device provides the advantages of resistance to damage from light, heat, chemical activity, and intrusion of dust and biological contaminants. The metallic membrane is resistant to wear, inexpensive to manufacture and provides shielding against radio-frequency interference. Moreover, the use of the normally closed and multiple throw features of this invention permits the elimination of auxiliary or adaptive circuitry and provides for greater flexibility in the design of circuitry to be associated with the keyboard.

BRIEF DESCRIPTION OF THE DRAWINGS

The above and other objects and features will become apparent with reference to the following specification and to the drawings wherein the vertical component of FIGS. 2 through *6b*, inclusive, is greatly exaggerated and not to scale.

FIG. *6a* shows a cross-sectional view of a metal coverlay embodying the present invention, under pressure.

FIG. *6b* shows a cross-sectional view of another embodiment of a metal coverlay of the present invention.

Figure 7:
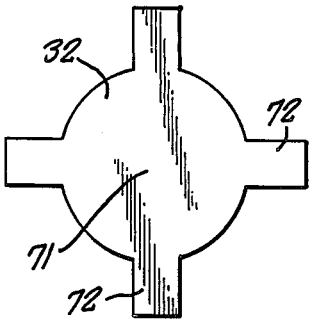

FIG. 7 shows a plan view of a conductive spring spider of a normally closed switch according to the present invention.

DESCRIPTION OF THE PREFERRED EMBODIMENT

Figure 1:
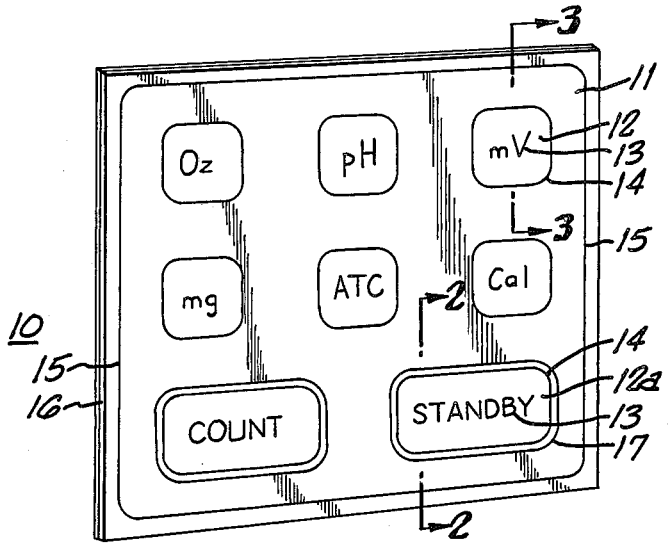
FIG. 1 is a simplified perspective view of a keyboard embodying the present invention in a preferred form.

Referring now to FIG. 1, there is illustrated a keyboard 10 having a metal keyboard coverlay 11. A plurality of key sites 12 are defined on the face of the coverlay 11 and are indicated by etched or printed indicia 13. Surrounding, coplanar with, and enclosing each key site is a groove 14.

The flexibility of the key sites 12 is provided through grooves 14 as discussed below. Additional flexibility may be made available with the provision of more grooves 17 as seen around the "STANDBY" key site of the drawing.

Coverlay 11 is bent or crimped to form ridge 15. Ridge 15 may be welded to another metal sheet 16 to provide hermetic sealing.

A circuit connector (not shown), such as a hermetically sealed plug may be installed in the back 16 of the keyboard to maintain the sealing of the present keyboard. Where the keyboard is not hermetically sealed by welding, it may also be convenient to install the circuit connector at the edge of the keyboard. Where the keyboards as described herein are to be used in a high-temperature environment, it is preferable to use appropriate internal components including metal-ceramic substrates and a glass and metal connector to pass signals to the associated apparatus.

It will be seen that other metals having specific advantages such as phosphor bronze, titanium, or beryllium copper may be employed to similar effectiveness in the metal coverlay sheet.

Figure 2:
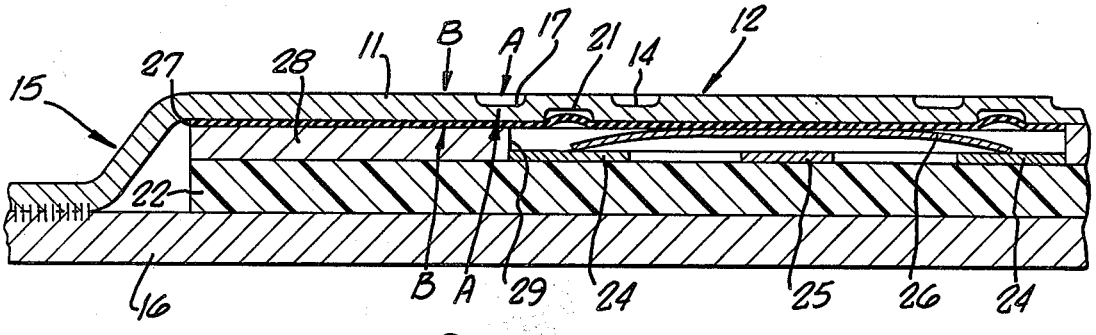
FIG. 2 is a cross-sectional view of a preferred form of the keyboard depicted in FIG. 1 taken through line 2—2 FIG. 1.

Turning to FIG. 2, it can be seen that the depth A of the groove 14 is approximately one-half the thickness B of the coverlay 11. Additionally, the coverlay 11 is provided with a groove 21 on the opposite side of the coverlay 11 and adjacent to groove 14. Preferably, the grooves 14 and 21 extend approximately half way through the coverlay 11 and their nearest edges are within a distance of approximately two to three times the thickness B of the coverlay 11. These grooves may be formed by any of a number of well-known methods including etching.

Where thicker metal is used, a deeper groove should be provided. It will be appreciated that where the grooves are etched, a widening of the grooves, known as over-etch, will take place. This widening dimension is typically equal to the depth of the etch.

A substrate 22, typically a printed circuit board, carries the switch circuitry including ring contact 24 and center contact 25. An electrically conductive dome 26 rests on ring contact 24 beneath each key site 12. The dome 26 is preferably a circular metal dome of known type. A thin insulator sheet 27 of urethane or polycarbonate on the underside of the coverlay 11 and a spacer 28 prevent the electrical shorting of the dome 26 or the printed circuitry by the metal coverlay 11. Alternatively, an insulator disc of mica or DuPont's KAPTON product, underlying the key site, may fulfill the function of the insulator sheet 27. Spacer 28 is provided with an opening 29 surrounding each dome 26.

When pressure is applied to key site 12, the central portion of dome 26 is pressed against the center contact 25 completing an electrical circuit between contacts 24 and 25 through the dome 26. The amount of force required to actuate the switch is reduced by the lateral proximity of groove 14 to the edge of groove 21 which facilitates the yielding of the metal sheet 11 at the key site 12. The actuating force is further reduced where additional grooves 17 are provided, thereby accentuating the bellows effect. Preferably, the grooves will be disposed on alternate sides of the metal sheet and be of approximately one-half the thickness B of the metal sheet.

Figure 3:
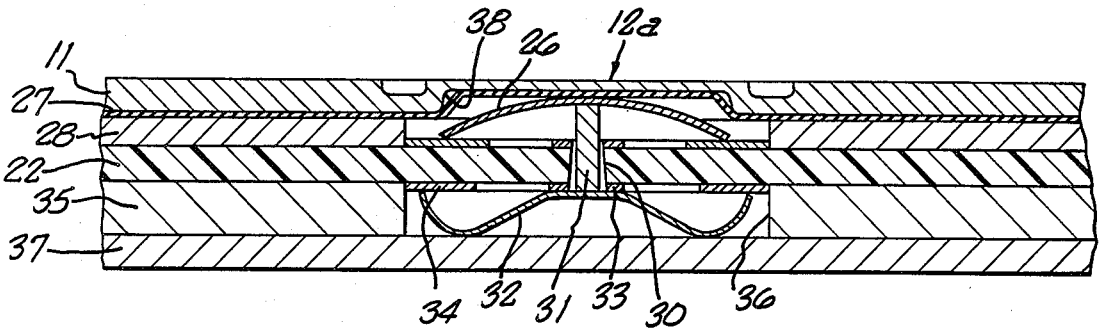
FIG. 3 is a cross-sectional view of another embodiment of the keyboard taken through line 3—3 depicted in FIG. 1, and showing the normally closed switch feature of the keyboard.

FIG. 3 shows a metal membrane switch which is normally closed. The substrate 22 includes a hole 30. A non-conductive rod or pellet 31 is in contact with dome 26 and, passing through the hole 30 in substrate 22, rests on spider 32. The spider 32 is a recurved, electrically conductive spring. Spider 32 rests on ring contact 34 and is normally in electrical contact with center contact 33. Spider 32 is held in position by inter-spacer 35 which includes an opening 36 around spider 32 and which is of sufficient height as seen in FIG. 3 to cause a second substrate 37 to urge spider 32 against contacts 33 and 34. When downward actuating force is applied against key site 12*a*, pellet 31 forces the center portion of spider 32 out of contact with contact 33, thereby interrupting an electrical circuit between contacts 33 and 34.

In this embodiment, a valley 38 is provided in place of the inner groove 21 of FIG. 2. This valley is coextensive with the key site 12*a*.

Figure 4:
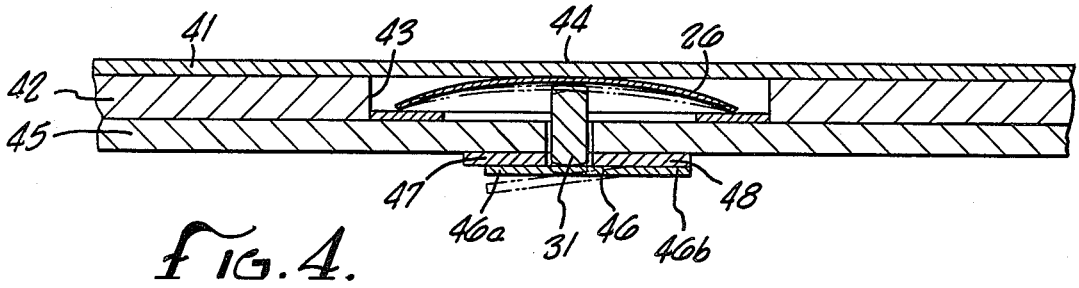
FIG. 4 shows a cross-sectional view of a keyboard with a conventional plastic coverlay and employing the normally closed switch feature of this invention.

FIG. 4 shows another normally closed switch having a conventional plastic cover 41. A spacer 42 is provided with an opening 43. Pressure on key site 44 actuates the dome 26 and the pellet 31 passing through the substrate 45. Pellet 31 pushes the moving end 46*a* of the electrically conductive leaf spring 46 out of communication with stationary contact 47 thereby opening the circuit. Normally, the electrical circuit remains closed because leaf spring 46 is biased by spring action against stationary contact 47. The fixed end of the leaf spring 46*b* is welded or soldered to the second stationary contact, thus completing the circuit between the contacts 47 and 48 and the leaf spring 46.

Figure 5:
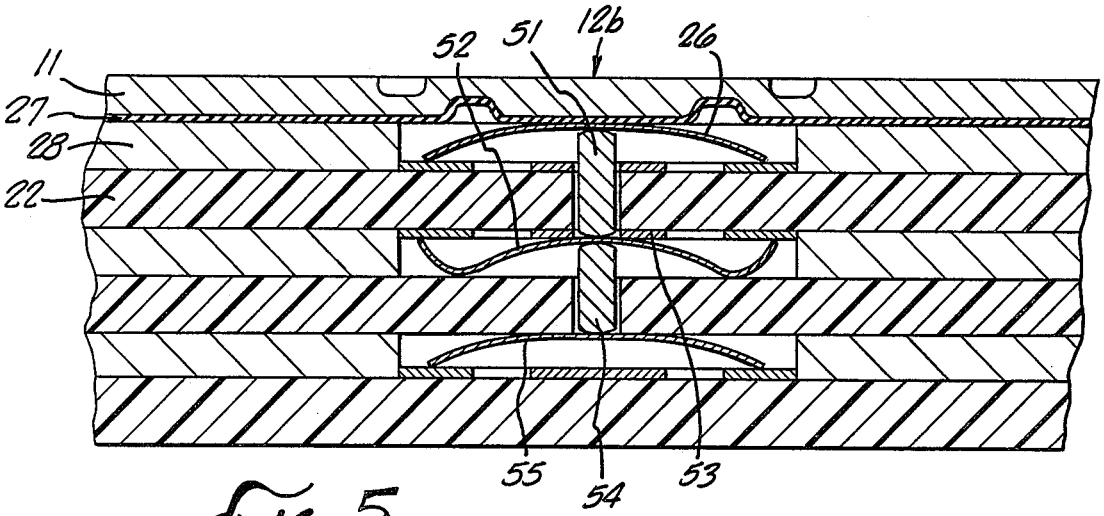
FIG. 5 shows a cross-sectional view of a multiple-throw switch according to the present invention.

FIG. 5 shows a triple-throw switch according to this invention. As can be seen from the drawing, the top and bottom throws are normally open, and the center is normally closed. When an actuating force is applied to the key site 12*b*, the dome 26 flexes to close the upper circuit. Additionally, a pellet 51 transmits the actuating movement to the spider 52 which is pushed out of engagement with its center contact 53 so as to open its associated circuit. Movement is further transmitted by means of a second pellet 54 to a dome 55 of the immediately vertically adjacent assembly to cause the dome 55 to close the switch in the same manner as discussed above. The second pellet 54, as well as any lower pellets are preferably of a generally compliant material such as urethane or rubber in order to accommodate variations in manufacture. This assembly may be stacked and expanded as necessary, and any combination of normally open and normally closed switches may be used.

Figure 6A:
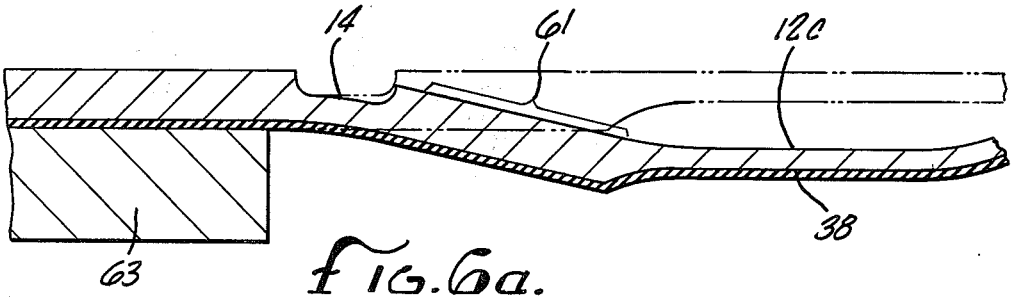

FIG. 6*a* demonstrates the bellows effect of a metal coverlay. Pressure being applied to key site 12*c* causes a slight flex in the coverlay over valley 38. Groove 14 is widened as a result of torsion of the coverlay in the flex zone 61. It will be appreciated by those skilled in the art that the degree of travel is enhanced by the cooperation of groove 14 and valley 38. Where spacer 63 stops short of the region in which flexing occurs, the movement of key site 12*c* will be made easier.

Figure 6B:
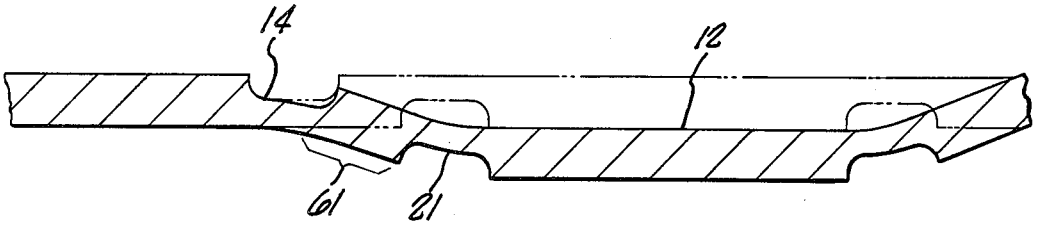

FIG. 6*b* shows a metal coverlay having a groove 14 on one side and another groove 21 on the other side of the metal coverlay 11. As can be seen, downward pressure causes movement of the key site 12. The movement is facilitated by the widening of the grooves 14 and 21 and the resulting torsion in the flex zone 61. It will be appreciated that the key site 12 of this embodiment undergoes less flex under pressure than does the key site in FIG. 6*a* wherein the key site is underlain by an area of reduced thickness, or valley, 38.

FIG. 7 is a plan view of the spring spider contact 32 of the normally closed switch of this invention. The spider includes center portion 71 which is urged away from contact with a center contact in switch operation. Legs 72 complete the electrical connection of the switch by resting in contact with a ring contact.

It is to be understood that the present invention is not limited to multiple switch arrays, but may also be employed in a single switch.

I claim:

1. A keyboard comprising a layer of metal etched with a plurality of closed-loop grooves, at least one pair of said grooves defining a keysite region wherein said region is made flexible by a bellows effect; and an insulating layer disposed between said keysite region and a switch contact;

wherein said keysite region is thinner than said layer of metal.

2. The invention of claim 1 wherein said grooves are disposed on alternate sides of the sheet.

3. The invention of claim 1 wherein the depths of said grooves are approximately one-half thickness of said layer of metal.

4. The device of claim 1 wherein at least a portion of said layer of metal is affixed to a base, said portion and said base thereby defining a sealed compartment.

5. The device of claim 1 wherein the laterally adjacent edges of a first and a second of said plurality of grooves are separated by less than approximately twice the thickness of said layer of metal.

6. A keyboard as claimed in claim 1, wherein said grooves are substantially shallower than the thickness of said layer of metal.

7. A keyboard as claimed in claim 1, wherein said layer of metal is substantially fluid-tight.

8. A keyboard as claimed in claim 1, wherein said key site region is substantially planar with a region of said layer of metal local to said key site region.

9. A keyboard comprising a metal sheet having at least one region defined by an area of reduced thickness and a groove surrounding said area, wherein said region is made flexible by a bellows effect; and an insulating layer disposed between said region and a switch contact;

wherein said region is thinner than said metal sheet.

10. The invention of claim 9 wherein said groove is on the opposite side of said sheet from said area of reduced thickness.

11. The invention of claim 9 wherein the depths of said groove and of said area of reduced thickness are approximately one-half the thickness of said metal sheet.

12. A keyboard comprising a layer of metal etched with a plurality of closed-loop grooves, at least one pair of said grooves defining a keysite region wherein said region is made flexible by a bellows effect, comprising first and second contact electrodes, a substrate having an opening therethrough, a resilient electrically conductive member in contact with said first contact electrode and held in contact with said second contact electrode by a spring force, such that an electrical circuit is completed between said first and second electrodes and the electrically conductive member, and a pellet positioned in said opening in said substrate, whereby movement of an actuating cover toward the substrate will be transmitted by the pellet through said opening in said substrate to the resilient electrically conductive member, urging it out of contact from said second contact electrode and thereby breaking the electrical circuit.

13. The invention of claim 12, further comprising a second pellet operatively connected to said first pellet disposed in line with said first pellet and said actuating cover;

a second resilient member operatively connected to said second pellet disposed in line with said second pellet and said actuating cover, whereby a spring force generated by said second resilient member causes said actuating cover to be urged outwardly from said substrate.

14. The invention of claim 13, wherein said second resilient member is a dome spring having an edge resting on a second substrate.

15. The invention of claim 12 wherein said keyboard includes a region with a pushbutton shape.

16. Apparatus comprising a plurality of switches arranged on an axis, each switch comprising first and second contact electrodes mounted on a flat substrate, and a resilient electrically conductive member for completing an electrical circuit between said first and second contact electrodes in a first position along said axis, and for opening said electrical circuit in a second position along said axis;

said first position and said second position being independently defined for each switch;

a pellet disposed between and resting against each resilient electrically conductive member and the resilient electrically conductive member immediately axially adjacent thereto; and each said substrate defining a hole through which said pellet may move, transmitting mechanical movement of an actuating cover to each electrically conductive resilient member.

17. The device of claim 16 wherein at least one of said pellets is of a generally compliant material.

18. The device of claim 16 wherein said substrates comprise circuit board material pre-impregnated with epoxy adhesive.

19. The device of claim 16 wherein at least one of said plurality of switches comprises a normally closed switch in which said resilient electrically conductive member rests in contact with said first and second contact electrodes, said pellet resting against said resilient electrically conductive member whereby mechanical movement of said actuating cover is transmitted to said member thus interrupting said electrical circuit.

20. A metal keyboard cover having at least one key site defined by and made flexible by the provision of substantially laterally adjacent grooves and having an insert capable of transmitting light being bonded to said cover over said opening;

an insulating layer disposed between said key site and a switch contact;

wherein said key site is thinner than said metal keyboard cover.

21. A keyboard comprising a hermetic layer of substantially non-resilient material;

at least one region in said layer defined by a plurality of closed-loop grooves, said region being made flexible by a bellows effect;

an insulating layer disposed between said region and a switch contact;

wherein said keysite region is thinner than said layer.

* * * * *